United States Patent [19]

Heitman

[11] 4,359,103

[45] Nov. 16, 1982

[54] GROUND-WORKING IMPLEMENT

[76] Inventor: Leroy M. Heitman, 28900 Ironwood, Sunnymead, Calif. 92388

[21] Appl. No.: 910,240

[22] Filed: May 30, 1978

[51] Int. Cl.[3] ..... A01B 49/02; E02F 3/76

[52] U.S. Cl. ..... 172/197; 172/484

[58] Field of Search ..... 172/195, 196, 197, 198, 172/199, 200, 464, 140, 484

[56] References Cited

U.S. PATENT DOCUMENTS 2,840,933 7/1958 Brem ..... 172/197 X 3,430,703 3/1969 Richey ..... 172/197 X

*Primary Examiner*—Richard J. Johnson

*Attorney, Agent, or Firm*—Harvey C. Nienow

[57] ABSTRACT

A ground-working implement to be attached to a tractor or other motive power means, to be pulled through and over the ground. It comprises a ripper having several ripping teeth which dig into the ground and are hydraulically adjustable by the operator of the tractor. A scraper is hingedly mounted relative to the ripper to be adjusted hydraulically by the operator from a raised or retracted position to a lowered operating position, there being locking means between the ripper teeth and the scraper comprising a locking bar on the scraper which is caused to fit within a notch or recess in the ripper teeth to lock the scraper into operating position as it is lowered.

9 Claims, 5 Drawing Figures

GROUND-WORKING IMPLEMENT

The present invention relates generally to ground-working implements to be attached to motive power means such as tractors and the like, but more particularly to such implements for loosening and smoothing ground or earth.

In preparing the ground or soil for any one of a myriad of purposes, it is desirable to be able to loosen the ground and thereafter to level the same by means of scrapping the ground to the proper elevation and slope. This is particularly necessary in preparing building sites and in sloping hillsides to the proper degree and elevation.

Although such operations have been performed by hand, within recent years accessories or attachments have been provided for tractors whereby the ground is ripped or leveled, depending upon the implement being used. That is, heretofore, separate implements or accessories have been required, one implement on one tractor for ripping, and another implement on another tractor for smoothing or scrapping the ground.

It is an object of the present invention to provide a ground-working implement which can be attached to a tractor and which can be used to rip or cut the ground or to scrape the same as required.

Another object of the present invention is to provide a ground-working implement as characterized above having remote control means whereby the operator of the tractor can select which of the functions is to be provided.

A still further object of the present invention is to provide a ground-working implement as characterized above wherein the ripper is provided with mounting means for connection to the tractor whereby the ripper teeth are maintained in predetermined depending relation throughout raising and lowering of the ripper.

A still further object of the present invention is to provide a ground-working implement as characterized above wherein the scraper is pivotally attached to the ripper so as to be movable into and out of operating position relative to the ripper.

An even further object of the present invention is to provide a ground-working implement as characterized above which comprises unique locking means for firmly securing the scraper in it's locked position with the ripper teeth when the former is in its operating position.

An even still further object of the present invention is to provide a ground-working implement as characterized above which is simple and inexpensive to manufacture and which is rugged and dependable in operation.

The novel features which I consider characteristic of my invention are set forth with particularity in the appended Claims. The invention itself, however, both as to its organization and mode of operation, together with additional objects and advantages thereof, will best be understood from the following description of specific embodiments when read in connection with the accompanying drawings, in which:

Like reference characters indicate corresponding parts throughout the several views of the drawing.

Figure 1:
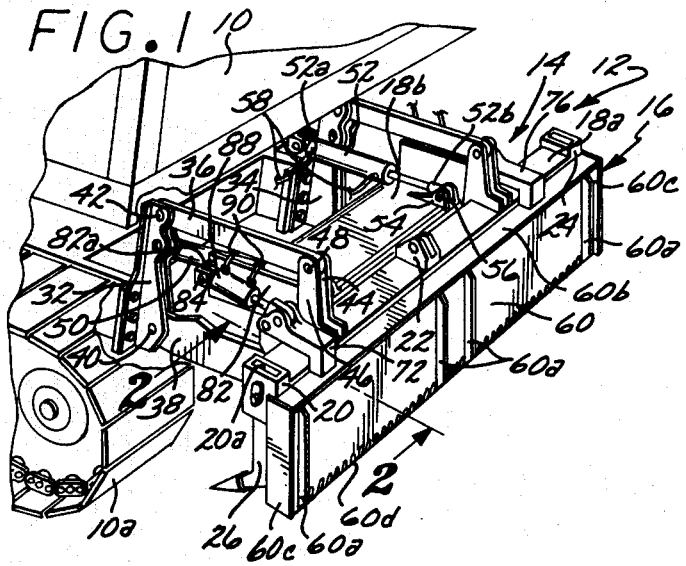
FIG. 1 is a fragmentary perspective view of a tractor adapted with the present ground-working implement.

Referring to FIG. 1 of the drawings, there is shown therein a tractor 10 on which is mounted a ground-working implement 12 according to the present invention.

Tractor 10 may be of substantially any design or construction, it merely being necessary that it be capable of pulling an implement over and through the ground or earth to be worked. The portion of tractor 10 shown in FIG. 1 comprises endless tracks **10*a*** but it could be provided with tractor wheels of substantially any design or construction.

The ground-working implement 12 comprises a ripper 14 and a scraper 16 which cooperate together in a unique fashion.

Figure 3:
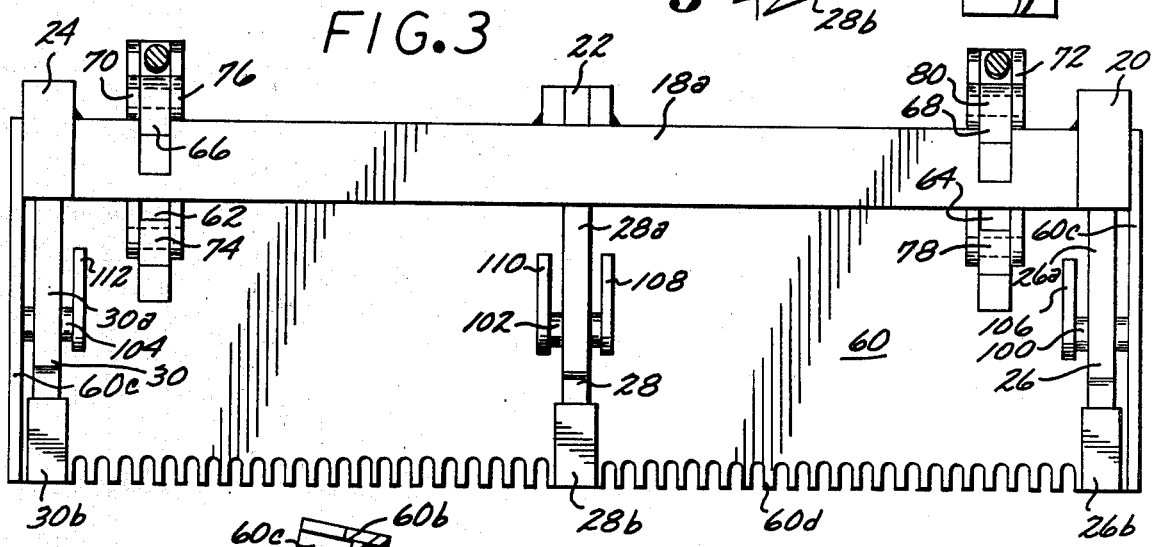
FIG. 3 is an elevational view of the implement, taken substantially along line 3—3 of FIG. 2.

Ripper 14 comprises a frame 18 having an elongated substantially horizontal box section frame member **18*a* and a flat horizontal frame member 18*b* attached thereto. The box section frame member 18*a* is provided with three (3) mounting members 20, 22 and 24 which are welded to the box section in vertical position as shown in FIGS. 1 and 3 of the drawings. The mounting members 20 and 24 are welded to the opposite ends of frame member 18*a* and the mounting member 22 is positioned in the middle thereof as shown. Referring to mounting member 20, as shown most particularly in FIG. 1 of the drawings, it is formed as a rectangular open box section having a rectangular vertically disposed opening or slot 20*a* for receiving a ripping member to be hereinafter described. An opening is provided in a sidewall of member 20** to receive fastening means for firmly anchoring the ripping member as will be apparent to those persons skilled in the art.

The mounting members 22 and 24 are substantially identical with member 20 to individually receive and retain a ripping member.

As shown most particularly in FIG. 3 of the drawings, there is provided, in the embodiment shown for illustration of the present invention, three (3) ripping members 26, 28 and 30 individually and respectively anchored in the mounting members 20, 22 and 24. Each such ripping member is formed with a generally L-shaped body as shown respectively at **26*a*, 28*a* and 30*a*, which slidably fit upwardly within the vertical slot of the respective mounting member. At the bottom of each such ripping member is a cutting or ripping tooth as shown respectively at 26*b*, 28*b* and 30*b***, which is formed of hard, wear-resistant steel for long life and effective operation in digging into the ground as will hereinafter become more apparent. As shown in the drawings, each tooth is formed with a cutting edge to more effectively and easily enter the ground.

As shown most effectively with respect to ripping member 26, each of the ripping members is vertically adjustable within its mounting member, as described above. In this regard a fastening device in the form of a fastening bolt is employed for mounting each of the ripping members relative to its mounting member.

To properly mount the ripper 14 relative to tractor 10, a pair of mounting brackets 32 and 34 are provided, one on each side of the rear of the tractor 10. Each bracket has a pair of spaced mounting plates, as shown. A pair of substantially parallel mounting arms 36 and 38 are provided for bracket 32 and a similar, if not identical, pair of arms are provided for bracket 34. One end of the lower arm 38 is pivotally mounted between the plates of bracket 32 by means of a pivot pin 40. One end of the upper arm 36 is similarly pivotally mounted on bracket 32 by means of a pivot pin 42. The other end of arm 38 is pivotally connected to frame member 18*a*, and the other end of arm 36 is pivotally connected to and between a pair of upstanding support members 44 and 46 by a pivot pin 48. Members 44 and 46 are firmly welded to frame member 18*a*.

The arms 36 and 38 thus cooperate with the bracket 32 and the frame member 18*a* to form a parallelogram mounting arrangement which enables the ripper 14 to be raised and lowered relative to the ground while maintaining the ripping members 26, 28 and 30 in the same vertical or depending relation relative to the ground.

The bracket 34 at the opposite side of tractor 10 is provided with a similar parallelogram arrangement so that the opposite sides or ends of the ripper 14 are raised and lowered in this particular manner.

To raise and lower ripper 14, there is provided on either side of frame 18 a hydraulic actuator 50 and 52. As shown most clearly with respect to actuator 52, one end 52*a* thereof is pivotally secured to mounting member 34 and the opposite end 52*b* is pivotally mounted to frame member 18*b* through a clevis 54 and pivot pin 56. Suitable hydraulic conduit 58 extend from control means (not shown) at the operators location on tractor 10 to the hydraulic actuators 50 and 52 to enable the operator to raise and lower the ripper 14.

Mounted on ripper 14 is the scraper 16. It comprises a rectangularly shaped steel plate 60 having reinforcing and stiffning members 60*a* on the face of the plate, a reinforcing member 60*b* along the upper edge thereof, and end reinforcing members 60*c* along the opposite side edges. The lower edge 60*d* of plate 60 is serrated as shown most particularly in FIGS. 1 and 3, to scrape across the ground as will hereinafter become more apparent.

Figure 2:
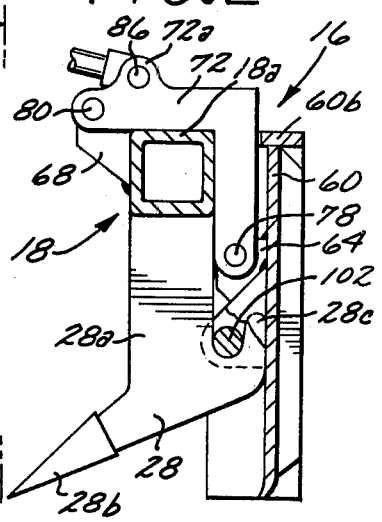
FIG. 2 is a sectional view through the ground-working implement taken substantially along line 2—2 of FIG. 1.

As shown in FIGS. 2 and 3 of the drawings, a pair of mounting tabs 62 and 64 are welded to the opposite end portions of one side of plate 60. Each such tab is generally triangular in shape, as shown in FIG. 2, and is formed with a through opening.

Firmly welded to frame member 18*a*, substantially in alignment with the aforementioned tabs 62 and 64 are extensions 66 and 68. A generally L-shaped lever arm 70 is pivotally mounted to and between tab 62 and extension 66. In like fashion another L-shaped lever arm 72 is pivotally connected to and between tab 64 and extension 68.

Each of the lever arms 70 and 72 is formed with a generally U-shaped crosssection and thus has opposite sides which are positioned on opposite sides of the respective tab and extension.

Thus the L-shaped lever arm 70 is a link between tab 62 and extension 66, by means of pivot pin 74 and 76 respectively. Also, the L-shaped lever arm 72 is a link between tab 64 and extension 68 by means of pivot pins 78 and 80. This arrangement affords pivotal movement of scraper plate 60 relative to ripper 14 as will hereinafter be described in greated detail.

As shown most particularly in FIG. 1 of the drawings, a mounting plate 82 is firmly welded to member 46 as to be immovable relative thereto. An L-shaped bracket 82*a* is secured to one end of plate 82 to receive a pivot pin 84.

Each of the L-shaped lever arms 70 and 72 is formed with a pair of offset portions, as shown at 72*a* with respect to lever arm 72. A pivot pin 86 is positioned in openings in the offset portions 72*a*.

A hydraulic actuator 88 pivotally mounted between the pins 84 and 86 and a similar actuator for the lever arm 70 enable the scraper plate 60 to be raised and lowered. Suitable hydraulic conduit 90 interconnect each of these actuators and suitable control means (not shown) in the operators position on the tractor 10.

Figure 4:
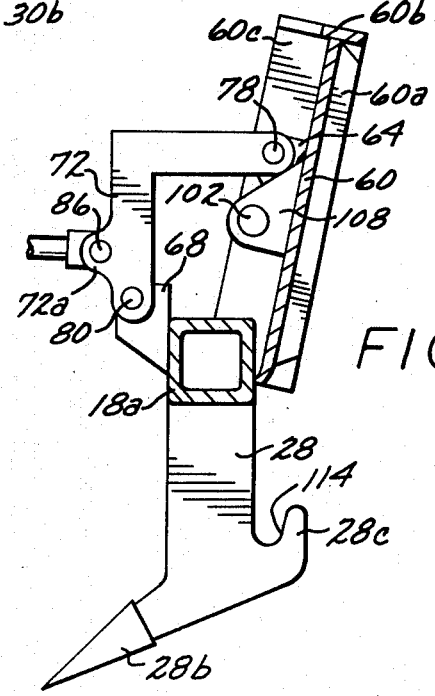
FIG. 4 is a sectional view similar to FIG. 2, but showing the scraper in raised position.

As shown most particularly in FIG. 4 of the drawings, the tabs 62 and 64 are welded to the scraper blade 60 at or near the vertical midpoint of such plate. As such, when the scraper 16 is raised to the position shown in FIG. 4, the plate 60 is caused to assume a canted position with the serrated lower edge of plate 60 against the ripper 14.

Aligned with each of the ripper members 26, 28 and 30, and firmly secured to scraper plate 60 but in spaced relation thereto, is a locking bar 100, 102 and 104. As shown most particularly in FIG. 3, the bar 100 is welded between the adjacent end plate 60*c* and a mounting tab 106. In similar fashion, the bar 102 is welded between a pair of mounting tabs 108 and 110 which are firmly welded between adjacent end plate 60*c* and a mounting tab 112 welded to plate 60.

For cooperation with such locking bars, each of the ripper members is formed with an offset as shown at 28*b* with respect to member 28 to afford an upwardly exposed notch or recess 114. The locking bar 102 is caused to fit within such recess 114 when the scrapper 16 is in its lowermost operating position. At the same time, of course, the other locking bars 100 and 104 are caused to fit within a corresponding notch or recess in the members 26 and 30, respectively.

Figure 5:
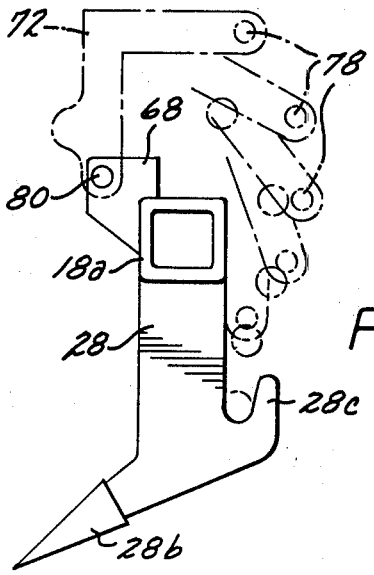
FIG. 5 is a phantom elevational view showing the motion of the scraper locking means.

FIG. 5 shows the movement of lever arm 72 in placing the scraper in operating position, the locking bar 102 swinging outwardly and thereafter inwardly toward the ripper member 28 as lever 72 is caused to pivot clockwise about pivot pin 68. Due to the afore described balancing of the scraper 16, locking bar 102 is ultimately caused to rest within the recess 114, as the locking bars 100 and 104 are caused to engage the similar recesses in ripper members 26 and 30.

As a result of this arrangement, the strength of ripper members 26, 28 and 30 is transmitted to the scraper 14 when the latter is in its operating position. By proper positioning of the locking bars on plate 60, the operating position of the serrated edge 60*d* of plate 60 can be controlled with respect to the ripper teeth 26*b*, 28*b* and 30*b*.

It is thus seen that the present invention provides a unique ripper and scraper ground-working implement for attachment to motive power means such as a tractor and the like, whereby the ground can be ripped or scraped, as desired, the operator of the tractor having the choice of which function to provide by suitable munipulation of control devices at the operator station of the tractor.

Although I have shown and described certain specific embodiments of my invention, I am well aware that many modifications thereof are possible. The invention is not to be restricted except insofar as is necessitated by the prior art and by the spirit of the appended Claims.

I claim:

1. A ground-working implement for attachment to motive power means comprising in combination, a ripper comprising an elongated frame and two or more ripping teeth depending therefrom in spaced relation, mounting and positioning means for said ripper connected to said frame and attachable to motive power means to be operable to position said teeth in raised position out of the ground or at any depth in the ground, said mounting means comprising a pair of mounting arms attached to said frame in vertically spaced relation and adapted to be connected relative to said motive power means in similarly vertically spaced relation to be substantially parallel throughout raising and lowering of said frame to thereby maintain said ripper teeth in predetermined depending relation, a scraper hingedly mounted on said frame and including operating means for alternatively placing said scraper in an inoperative position above said teeth regardless of the depth of said teeth in the ground and in an operative scraping position relative to said teeth, and remote controlled second operating means operatively interposed between the motive power means and said frame for raising and lowering of the latter.

2. A ground-working implement for attachment to motive power means according to claim 1 wherein said second operating means comprises a hydraulic actuator one end of which is connected relative to said frame and the other end of which is adapted to be connected relative to said motive power means.

3. A ground-working implement for attachment to motive power means comprising in combination, a ripper comprising an elongated frame and two or more ripping teeth depending therefrom in spaced relation, mounting and positioning means for said ripper connected to said frame and attachable to motive power means to be operable to position said teeth in raised position out of the ground or at any depth in the ground, a scraper hingedly mounted on said frame and including hydraulic means therebetween for alternatively placing said scraper in an inoperating position above said teeth regardless of the depth of said teeth in the ground and in an operative scraping position relative to said teeth, locking means between said scraper and said ripper teeth to anchor said scraper to said teeth when said scraper is in its lowered operating position.

4. A ground-working implement for attachment to motive power means comprising in combination, a ripper comprising an elongated frame and two or more ripping teeth depending therefrom in spaced relation, mounting means on said frame and attachable to motive power means to be operable to raise and lower said ripper frame, a scraper hingedly mounted on said frame and including hydraulic operating means interposed between said scraper and said frame for raising and lowering said scraper relative to said ripping teeth, and locking means including at least one horizontal locking bar on said scraper in spaced relation thereto and a recess member relative to one of said ripper teeth to receive and retain said locking bar when said scraper is in its operative position.

5. A ground-working implement for attachment to motive power means according to claim 4 wherein said scraper is hingedly mounted on said frame by at least two L-shaped levers the opposite ends of each of which are hingedly mounted relative to said frame and scraper respectively.

6. A ground-working implement for attachment to motive power means according to claim 5 wherein said scraper comprises a rectangular metal plate, the corresponding end of said L-shaped lever being pivotally attached thereto near the vertical midpoint of said plate.

7. A ground-working implement for attachment to motive power means according to claim 6 wherein said frame includes a substantially vertically positioned mounting sleeve for each of said ripper teeth to mount the same in depending position, and each tooth is provided with an upwardly exposed notch for receiving a locking bar on said scraper.

8. A ground-working implement for attachment to motive power means according to claim 7 wherein the plate of said scraper is formed with a serrated lower edge for scraping engagement with the ground when in its lowered operating position.

9. A ground-working implement for attachment to motive power means comprising in combination, a ripper comprising an elongated frame and two or more ripper teeth depending therefrom in spaced relation, mounting means on said frame and attachable to motive power means to be operable to raise and lower said ripper frame, a scraper hingedly mounted on said frame and including hydraulic operating means interposed between said scraper and said frame for raising and lowering said scraper relative to said ripper teeth, and locking means interposed between said scraper and said ripper teeth to firmly connect said scraper to said teeth when, but only when, said scraper is in its lower position.

* * * * *